US005828041A

United States Patent [19]

Hoh et al.

[11] Patent Number: 5,828,041

[45] Date of Patent: Oct. 27, 1998

[54] POWER SUPPLY CUT-OFF APPARATUS OF A MICROWAVE OVEN

[75] Inventors: Jung-Eui Hoh; Young-Won Cho, both of Suwon; Hong-Kil Choe, Kyungki-Do, all of Rep. of Korea

[73] Assignee: Samsung Electronics Co., Ltd., Suwon, Rep. of Korea

[21] Appl. No.: 874,327

[22] Filed: Jun. 13, 1997

[30] Foreign Application Priority Data

| | | | |
|---|---|---|---|
| Jun. 27, 1996 | [KR] | Rep. of Korea | 1996 18062 |
| Jul. 1, 1996 | [KR] | Rep. of Korea | 1996 19547 |
| Sep. 3, 1996 | [KR] | Rep. of Korea | 1996 28034 |
| Mar. 5, 1997 | [KR] | Rep. of Korea | 1997 7290 |

[51] Int. Cl.[6] ..... H05B 6/68

[52] U.S. Cl. ..... 219/702; 219/715; 219/723; 219/756; 200/50.02; 200/61.62; 126/275 E; 361/114

[58] Field of Search ..... 219/723, 722, 219/724, 756, 702, 715; 200/50.02, 50.14, 50.08, 50.1, 61.62, 61.76, 61.81; 126/197, 275 E; 361/1, 114

[56] References Cited

U.S. PATENT DOCUMENTS 4,277,659 7/1981 DeRemer ..... 200/61.62

FOREIGN PATENT DOCUMENTS 52-37241 3/1977 Japan ..... 219/723
55-56534 4/1980 Japan ..... 219/722

*Primary Examiner*—Philip H. Leung
*Attorney, Agent, or Firm*—Burns, Doane, Swecker & Mathis, L.L.P.

[57] ABSTRACT

A microwave oven includes a housing formed by relatively separable first and second panels. Electric switches are mounted on the first panel and are connected to respective wires of the power cord by the oven. Each switch includes a movable contact which moves away from a respective fixed contact when the panels are separated from one another, in order to automatically cut off the supply of electric power to the oven in the event that the worker forgets to unplug the power cord. When the panels are reconnected, the switches are automatically closed. Such automatic closing can be caused by magnetic force produced by magnets carried by the second panel. Alternatively, the automatic closing can be caused by screws carried by the second housing and which physically push respective movable contacts against their associated fixed contacts.

6 Claims, 5 Drawing Sheets

POWER SUPPLY CUT-OFF APPARATUS OF A MICROWAVE OVEN

BACKGROUND OF THE INVENTION

1. Field of the Invention

The present invention relates to a microwave oven and, in particular, to a power supply cut-off apparatus by which an input power supply can be automatically cut off when an outer panel is separated while an electric cord is still plugged in an outlet during repair or maintenance thereon.

2. Description of the Prior Art

A conventional microwave oven, as illustrated in FIGS. 1 and 2, includes a housing 60 forming a cooking chamber 10. The housing includes a front panel 20, a back panel 30, a base panel 40 and an outer panel 50, a turn table 70 rotatively disposed on a floor of the cooking chamber 10, a door for opening and closing an opening of the cooking chamber 10, and a control unit 90 for establishing cooking function modes or for operating a magnetron (not shown), or the like.

In order to drive the microwave oven thus constructed, when a door open button at the control unit 90 is pressed while an electric cord 100 is still plugged in an outlet, the door 80 is opened to light a lamp in the cooking chamber 10.

At this time, food is placed on the turntable 70 disposed on the floor of the cooking chamber 10, the door 80 is closed, desired cooking time and cooking menu and the like are input by the control unit 90, and a start button is pressed. Then the turntable 70 is rotated in one direction as a high frequency of 2,450 MHz is generated according to an oscillating operation of a magnetron (not shown) to thereafter be dispersed in the cooking chamber.

The high frequency dispersed in the cooking chamber is reflected from metal walls therein and is radiated to the food on the turntable 70 to thereby heat the food.

However, there is a problem in the conventional microwave oven thus constructed in that an electric shock to a worker may result when the outer panel 50 is separated while the electric cord 100 is still in the outlet during repair or maintenance of the product.

SUMMARY OF THE INVENTION

Accordingly, the present invention is provided to solve the aforementioned problem and it is an object of the present invention to provide a power supply cut-off apparatus of a microwave oven by which an input power supply is automatically cut off, to thereby prevent an electric shock, when an outer panel is separated while an electric cord is still plugged in an electric outlet.

In accordance with the object of the present invention, there is provided a power supply cut-off apparatus for a microwave oven having a cavity and a housing formed by interconnected housing portions, including a front panel, a back panel, a base panel and an outer panel, the apparatus comprises a switch box connected to an electric cord and including magnets for causing switches to be closed for supplying electric power to the oven. When the outer panel is disassembled, the magnets no longer keep the switches closed. Rather, the switches open for automatically cutting off the supply of electric power.

In accordance with the object of the present invention, there is provided a power supply cut-off apparatus of a microwave oven having a removable outer panel during a repair; the apparatus involves a switch box mounted on a back panel for being in electric contact with an electrical cord, and first, second and third screws causing switches to be closed for supplying electric power to the oven. When the outer panel is disassembled, the screws are removed and no longer keep the switches closed. Rather, the switches open for automatically cutting off electric power supplied to the oven by turning off three wires of the source of electric power disposed in the switch box.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF PREFERRED EMBODIMENTS OF THE INVENTION

Figure 1:
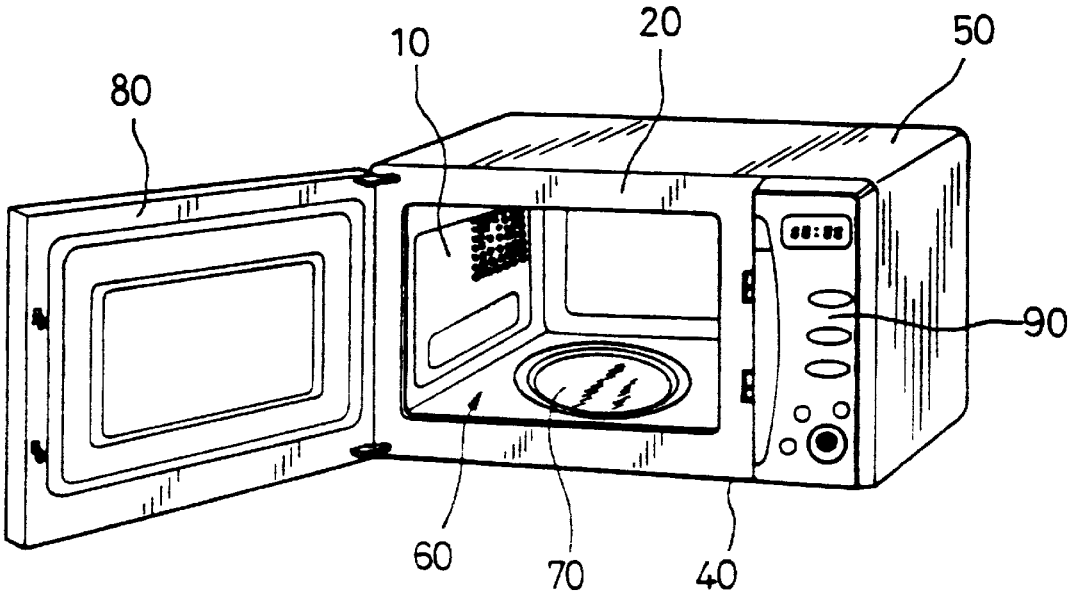
FIG. 1 (PRIOR ART)
FIG. 1 is a perspective view for illustrating a front surface of a microwave oven according to the prior art.
Figure 2:
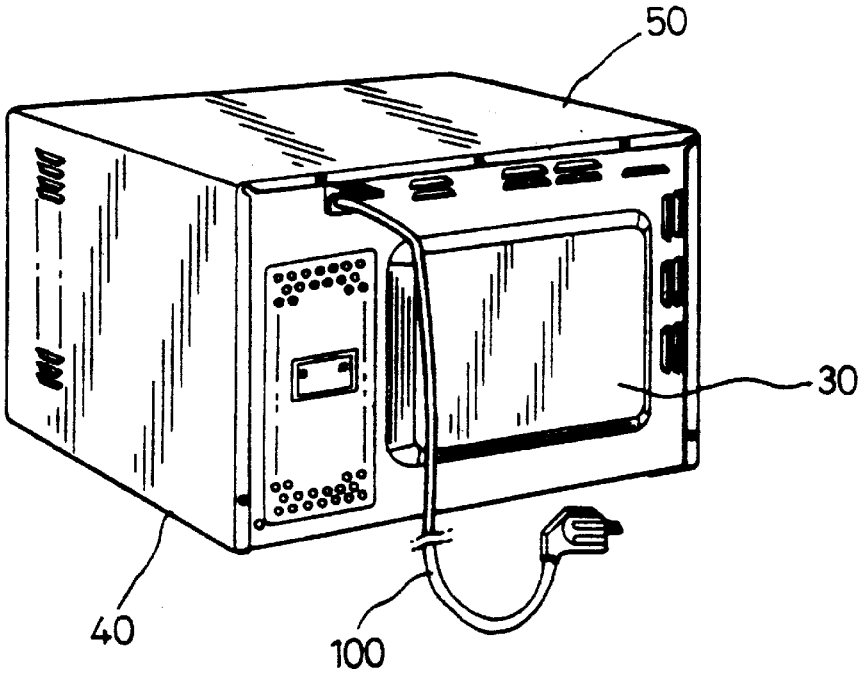
FIG. 2 (PRIOR ART)
FIG. 2 is a perspective view for illustrating a rear surface of a microwave oven according to the prior art.

Preferred embodiments of the present invention will now be described in detail with reference to the accompanying drawings. Throughout the drawings, like reference numerals and symbols are used for designation of like or equivalent parts or portions for simplicity of illustration and explanation, and redundant references will be omitted.

Figure 4:
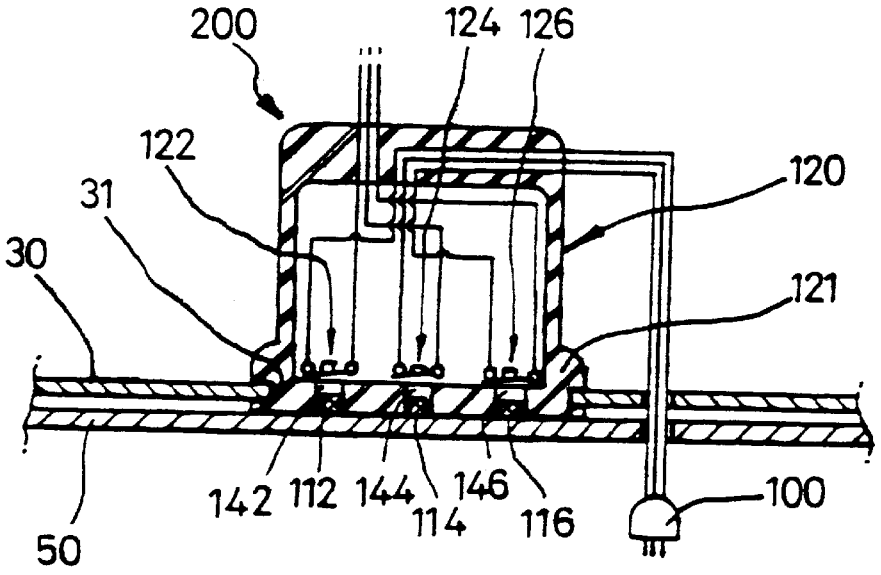
FIG. 4 is a cross-sectional view for illustrating an assembled state of a power supply cut-off apparatus taken along a line A—A shown in FIG. 3.

In FIG. 4, reference numeral 200 designates electric power cut-off means by which an electrical connection is automatically disconnected when an outer panel and a back panel are separated from one another during a repair of the microwave oven. Thus, the main power supply applied to the microwave oven is automatically cut off by turning off three wires of the source of electric power, even if the electric cord is still plugged in an electric socket.

Figure 3:
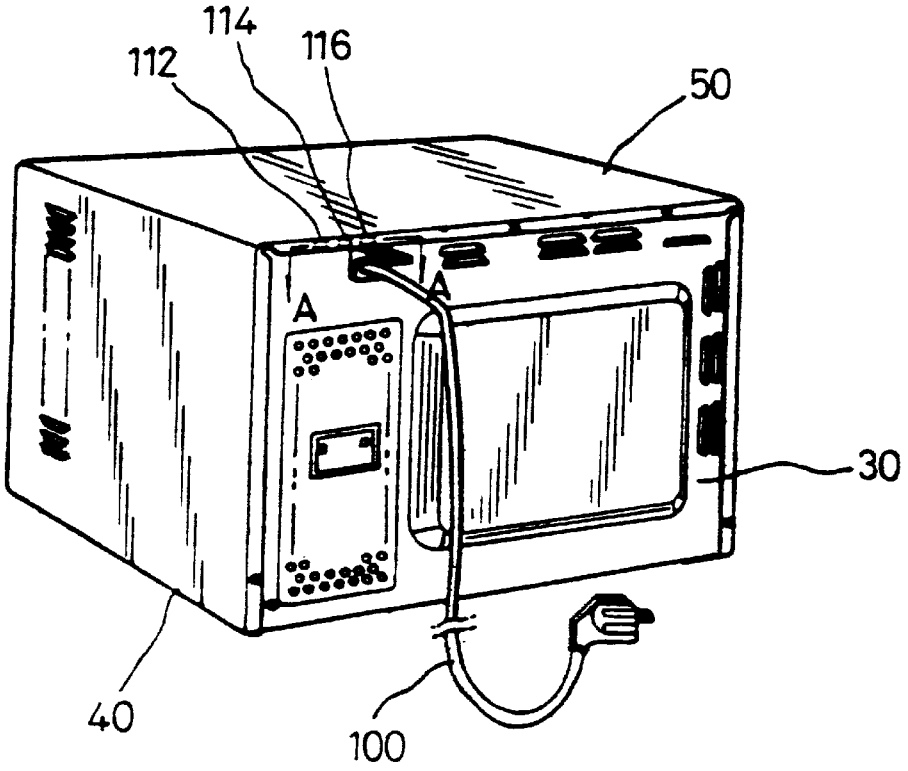
FIG. 3 is a perspective view for illustrating a rear side of a microwave oven having an electric power cut-off apparatus according to a first embodiment of the present invention.

In the electric power cut-off apparatus, as illustrated in FIGS. 3 and 4, the outer panel 50 is provided on an inner side thereof with first, second and third magnets 112, 114 and 116, and the back panel 30 connected to the outer panel is provided on its inner side with a switch box 120 electrically connected with an electric cord 100.

The switch box, illustrated in FIG. 4, includes an insulating member 121 secured in a hole 31 of the back panel 30, and first, second and third holes 142, 144 and 146 formed in the insulating member for receiving the first, second and third magnets 112, 114 and 116. Disposed in the insulating member 121 are first, second and third switches 122, 124 and 126 for performing a turning-on/off operation to cut off or conduct electric power via the cord 100, due to a magnetic field generated by the first, second and third magnets 112, 114 and 116.

Figure 5:
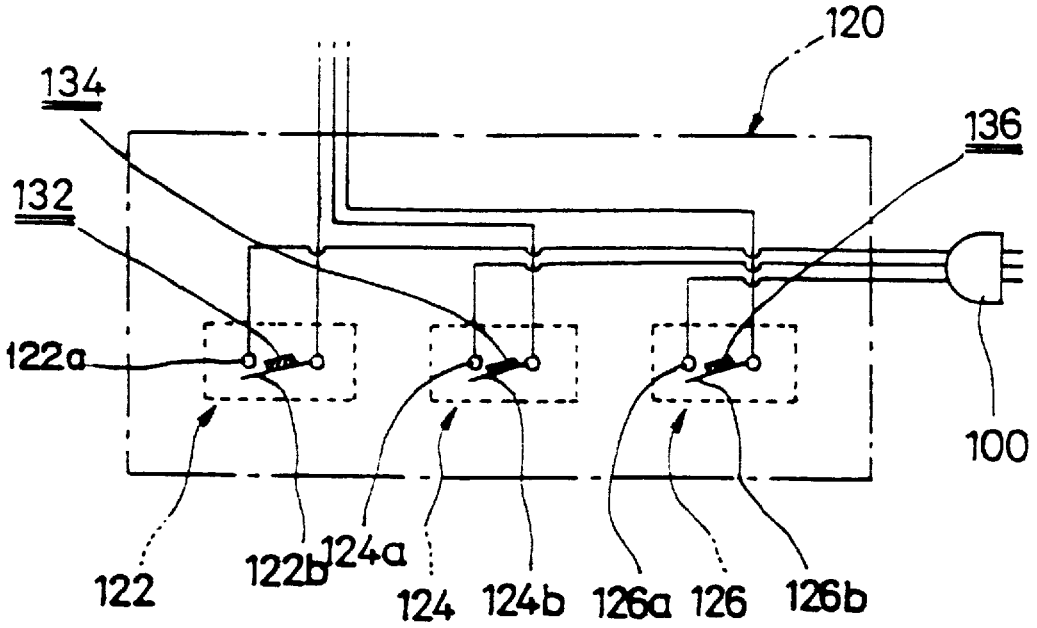
FIG. 5 is a circuit diagram for illustrating a switch box according to the first embodiment of the present invention depicting a normal state of switches when panels of the oven are disassembled.

The first, second and third switches 122, 124 and 126, as illustrated in FIG. 5, include first, second and third magnetic substances 132, 134 and 136; fixed contacts 122*a*, 124*a* and 126*a*; and movable contacts 122*b*, 124*b* and 126*b*. The first, second and third magnetic substances 132, 134 and 136 are disposed at predetermined positions, where the magnetic substances can react to the first, second and third magnets 112, 114 and 116, respectively. The fixed contacts 122*a*, 124*a* and 126*a* are in electric contact with three wires of the source of electric power. The movable contacts 122*b*, 124*b* and 126*b* are electrically connectable to the fixed contacts 122*a*, 124*a* and 126*a* so as to perform turning-on/off operations according to the magnetic fields generated by the first, second and third magnetic substances 132, 134 and 136, and also are in electric contact with electric parts in the oven.

Next, the operation of the power supply cut-off apparatus of a microwave oven according to one embodiment of the present invention thus constructed will be described.

When the panels of the oven are to be opened-up for repair or maintenance, e.g., when the outer panel 50 and the back panel 30 are disconnected from one another by the removal of screw fasteners, the outer panel 50 is separated from the back panel 30 so that the first, second and third magnets 112, 114 and 116 leave the first, second and third holes 142, 144 and 146 of the switch box.

Accordingly, since the first, second and third magnetic substances 132, 134 and 136 are no longer repelled by the magnetic force of the magnets, the movable contacts 122*b*, 124*b* and 126*b* elastically flex to become separated from the fixed contacts 122*a*, 124*a* and 126*a* to automatically cut off the supply of electric power applied to the oven, thereby preventing the worker from receiving an electrical shock.

Meanwhile, when the repair is finished, and the outer panel 50 and the back panel 30 are tightly assembled by replacing screws in order to reassemble the outer panel 50 and the back panel 30, the first, second and third magnets 112, 114 and 116 re-enter the first, second and third holes 142, 144 and 146.

Accordingly, the first, second and third magnetic substances 132, 134 and 136 are disposed in the switch box 120 and are under the influence of the magnetic force generated by the magnets 112, 114 and 116 to thereby automatically engage the movable contacts 122*b*, 124*b* and 126*b* with the fixed contacts 122*a*, 124*a* and 126*a*, thereby re-establishing the supply of electric power to the microwave oven.

As is apparent from the foregoing, the power supply cut-off apparatus in accordance with one embodiment of the present invention prevents the worker from receiving an electric shock when the outer panel is dismounted while the electric cord is still plugged in an electric outlet.

Next, a second embodiment of the present invention will now be described in detail with reference to the accompanying drawings. Throughout the drawings, like reference numerals and symbols are used for designation of like or equivalent parts or portions for simplicity of illustration and explanation, and redundant reference will be omitted.

Figure 7:
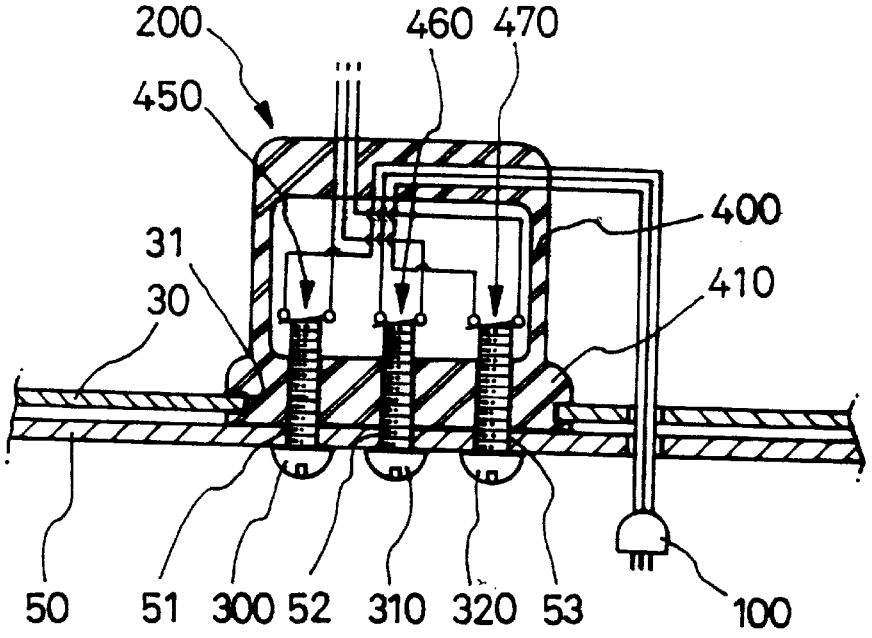
FIG. 7 is a cross sectional view for illustrating an assembled state of an electric power cut-off apparatus taken along a line A'—A' shown in FIG. 6.
Figure 8:
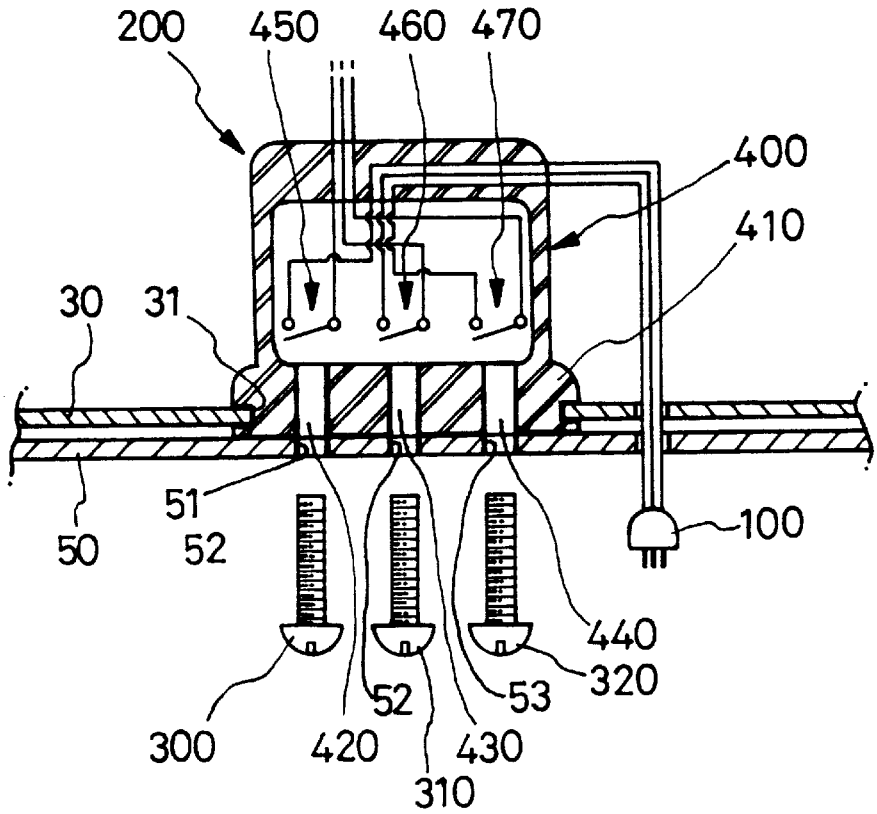
FIG. 8 is a cross sectional view for illustrating a disassembled state of an electric power cut-off apparatus taken along the line A'—A' shown in FIG. 6 and depicting a normal state of switches when panels of the oven are disassembled.

In FIGS. 7 and 8, reference numeral 200 designates a power supply cut-off means by which an electrical connection is automatically disconnected by forcing three wires of the source of electric power into a turning-off state when the outer panel 50 and the back panel 30 are disassembled during repair or maintenance of the microwave oven. Thus, the main power supply applied to the microwave oven is automatically cut off, even if the electric cord is still plugged into an electric socket.

Figure 6:
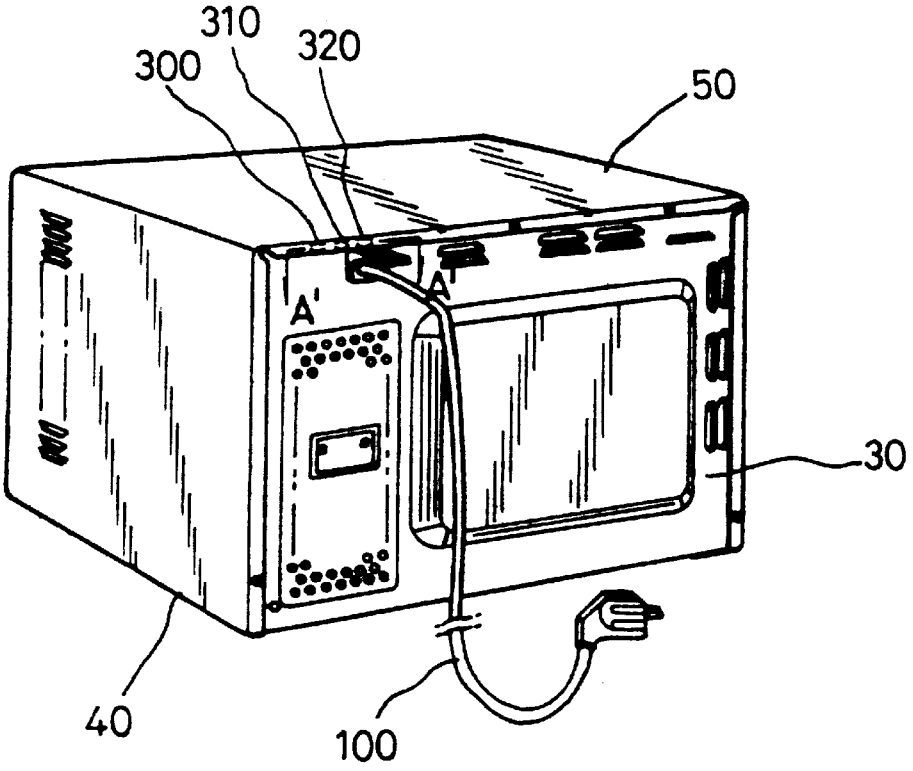
FIG. 6 is a perspective view for illustrating a rear side of a microwave oven having an electric power cut-off apparatus according to a second embodiment of the present invention.

In other words, the power supply cut-off means, as shown in FIGS. 6, 7 and 8, involves a switch box 400, and first, second and third screws 300, 310 and 320. The switch box is mounted on the back panel 30 and electrically connected with the electric cord 100. The screws 300, 310 and 320 cause electrical current to flow in the three wires when the outer panel 50 and the switch box 400 are in an assembled state and cause the current flow in the wires to be shut off when the panel 50 and switch box 400 are in a disassembled state to thereby cut off the supply of electric power applied to the oven.

At this time, the outer panel 50 is formed at a rear side thereof with the first, second and third holes 51, 52 and 53, so that the first, second and third screws 300, 310 and 320 can be inserted by projecting through the elongated holes formed in the outer panel 50.

The ends of the first, second and third screws 300, 310 and 320 are coated with an electric insulating material in order to prevent the flow of current through the screws while the screws are assembled with the switch box 400.

Meanwhile, the switch box 400 includes an insulating member 410, first, second and third screw holes 420, 439 and 440, and first, second and third switches 450, 460 and 470. The insulating member 410 is inserted through the hole of the back panel 30. The first, second and third screw holes 420, 430 and 440 are formed at one side of the switch box 400 so that the screws 300, 310 and 320 are inserted there into. The first, second and third switches 450, 460 and 470 are mounted at positions corresponding to the first, second and third screw holes 420, 430 and 440, thereby respectively cutting off or supplying an electric power applied to the oven in response to a press operation or a release operation of the screws 300, 310 and 320.

Figure 9:
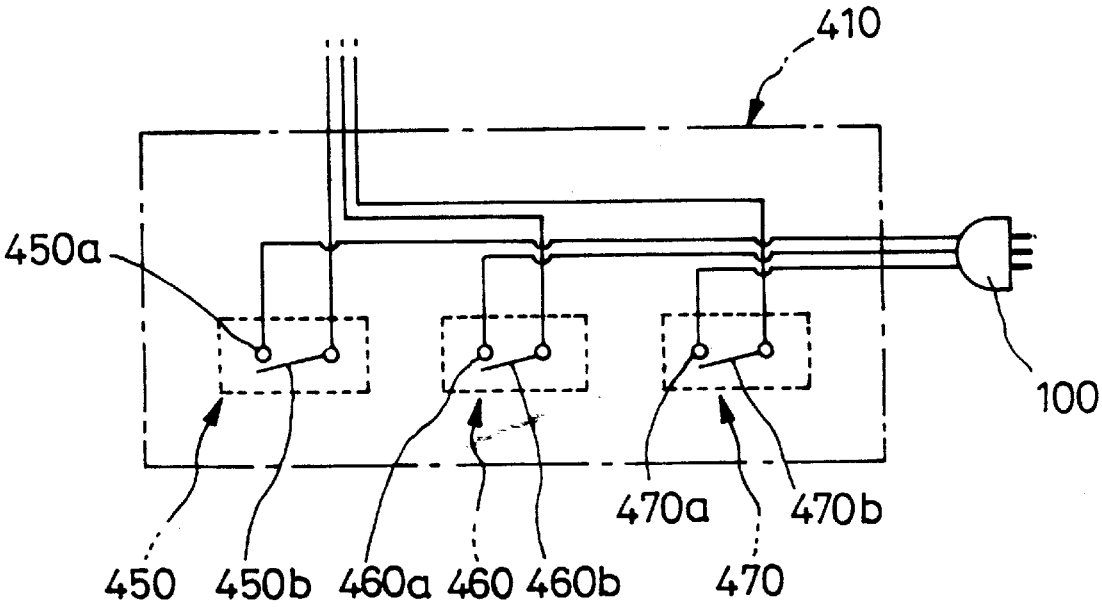
FIG. 9 is a circuit diagram for illustrating a switch box according to the second embodiment of the present invention.

At this time, the first, second and third switches 450, 460 and 470, as shown in FIG. 9, include fixed contacts 450*a*, 460*a* and 470*a* electrically connected with three wires of the electric cord 100, and movable contacts 450*b*, 460*b* and 470*b* for being in electric contact with three wires of the electronic parts in the oven in order to move in response to press operation or release operation of the screws 300, 310 and 320.

Now, the operation of the power supply cut-off apparatus of a microwave oven according to the second embodiment of the present invention thus constructed will be described.

When the outer panel 50 is disconnected from the oven by releasing the screws 300, 310 and 320 for repair or maintenance and the outer panel 50 is pulled backward, the back panel 30 is separated from the back panel 50 to thereby expose the cooking chamber 10.

At this time, when the first, second and third screws 300, 310 and 320 are separated from the screw holes 420, 430 and 440 the movable contacts 450*b*, 460*b* and 470*b* elastically flex away from the fixed contacts 450*a*, 460*a* and 470*a* to automatically cut off the power supply applied to the microwave oven while the electric cord 100 is still plugged into an outlet (not shown), thereby preventing the worker from receiving electric shock.

Meanwhile, when the repair is finished, and the first, second and third screws 300, 310 and 320 are inserted into the holes 51, 52 and 53 of the outer panel 50 and at the same time, inserted into the first, second and third screw holes 420, 430 and 440 formed in the body 410 of the switch box 400 in order to reassemble the outer panel 50 to the back panel 30, the ends of the first, second and third screws 300, 310 and 320, as shown in FIG. 7, press the movable contacts 450*b*, 460*b* and 470*b* into electric contact with the fixed contacts 450*a*, 460*a* and 470*a* thereby reestablishing the supply of power to the microwave oven.

As is apparent from the foregoing, there results an advantage from the power supply cut-off apparatus in that an electric connection of a switch is automatically turned off by disconnecting three wires of the source of electric power when the outer panel and the back panel are separated from one another while an electric cord is still plugged into an outlet, to thereby cut off the main power supplied to the microwave oven and prevent an electric shock possibly caused in the course of repair work of the microwave oven.

What is claimed is:

1. A microwave oven comprising:

a housing forming a cooking chamber supplied with microwaves by a magnetron, the magnetron being energized by electricity received through an electric power cord, the housing including relatively separable first and second panels;

a switch box mounted on the first panel and including switches connected to respective wires of the power cord; and magnets mounted to the second panel for causing the switches to be closed when the first and second panels are assembled together, the switches moving to an open state when the first and second panels are separated from one another, to cut-off a supply of electric power to the microwave oven.

2. The microwave oven according to claim 1 wherein the switch box includes a body connected to the first panel, the switches disposed in the body, the body including holes for receiving respective ones of the magnets.

3. The microwave oven according to claim 1 wherein magnets constitute first magnets, the movable contacts carry second magnets for reaction with respective ones of the first magnets.

4. A microwave oven comprising:

a housing forming a cooking chamber supplied with microwaves by a magnetron, the magnetron being energized by electricity received through an electric power cord, the housing including relatively separable first and second panels;

a switch box mounted to the first panel and including switches connected to respective wires of the power cord; and screws insertable through the first and second panels when the first and second panels are assembled, for displacing respective ones of the switches to closed states, the switches moving to an open state when the screws are removed to enable the first and second panels to be separated from one another, and thereby cutting-off a supply of electric power to the microwave oven.

5. The microwave oven according to claim 4 wherein the screws are coated with insulating material to prevent current from flowing therethrough.

6. The microwave oven according to claim 4 wherein the switch box includes a body connected to the first panel, the switches disposed in the body, the body including holes for receiving respective ones of the screws and located to enable the screws to engage the movable contacts.

* * * * *